United States Patent [19]

Tissot et al.

[11] Patent Number: 4,965,889

[45] Date of Patent: Oct. 30, 1990

[54] COVER FOR A TOILET BOWL

[75] Inventors: Patrick Tissot; Jean Guy; Claude Patel, all of Nantua, France

[73] Assignee: Tissot, S.A., Nantua, France

[21] Appl. No.: 312,098

[22] Filed: Feb. 17, 1989

[30] Foreign Application Priority Data

Feb. 18, 1988 [FR] France ..... 88 02503

[51] Int. Cl.[5] ..... A47K 13/00

[52] U.S. Cl. ..... 4/234; 4/236; 4/237; 4/240

[58] Field of Search ..... 4/237, 238, 239, 240, 4/241, 242, 234, 235, 236

[56] References Cited

U.S. PATENT DOCUMENTS

| | | | |
|---|---|---|---|
| 3,670,441 | 6/1972 | Blount | 4/235 |
| 4,173,802 | 11/1979 | Wikstrom | 4/236 |
| 4,438,535 | 3/1984 | Paredes | 4/234 |
| 4,680,816 | 7/1987 | Colombani | 4/240 |
| 4,724,551 | 2/1988 | Gardner | 4/236 |

FOREIGN PATENT DOCUMENTS

| | | | |
|---|---|---|---|
| 0014325 | 1/1980 | European Pat. Off. . | |
| 0225427 | 7/1986 | European Pat. Off. . | |
| 1200475 | 12/1959 | France | 4/236 |
| 1230623 | 5/1971 | United Kingdom | 4/234 |

*Primary Examiner*—Henry J. Recla
*Assistant Examiner*—Edward C. Donovan
*Attorney, Agent, or Firm*—Browdy and Neimark

[57] ABSTRACT

Said cover (1) comprises a seat (3) and a lid (4), which are hinged on a base (6) attached to the back of bowl (2). Seat (3) and lid (4) are joined together by hinge (5) and quick fastening device (8, 19) is provided to attach seat/lid unit (3, 4) to fixed base (4), or to unlock said unit so that it may be removed, without separating seat (3) from lid (4). Said disassembly and reassembly operations, especially for cleaning purposes, are thus facilitated.

1 Claim, 5 Drawing Sheets

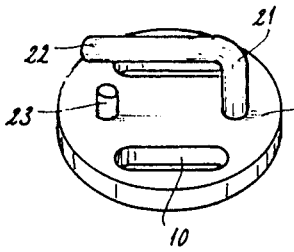
FIG. 11
FIG. 10
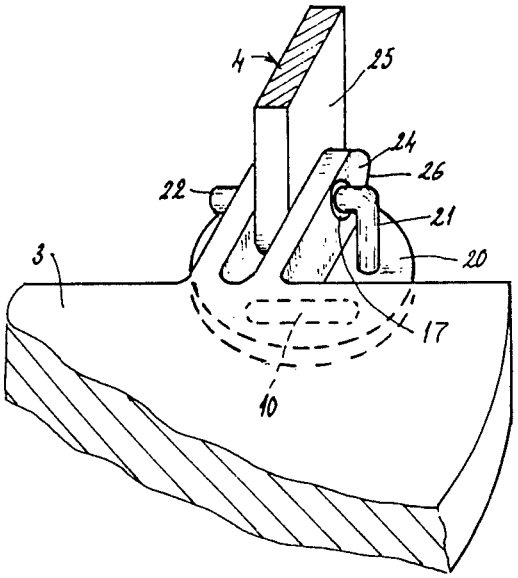
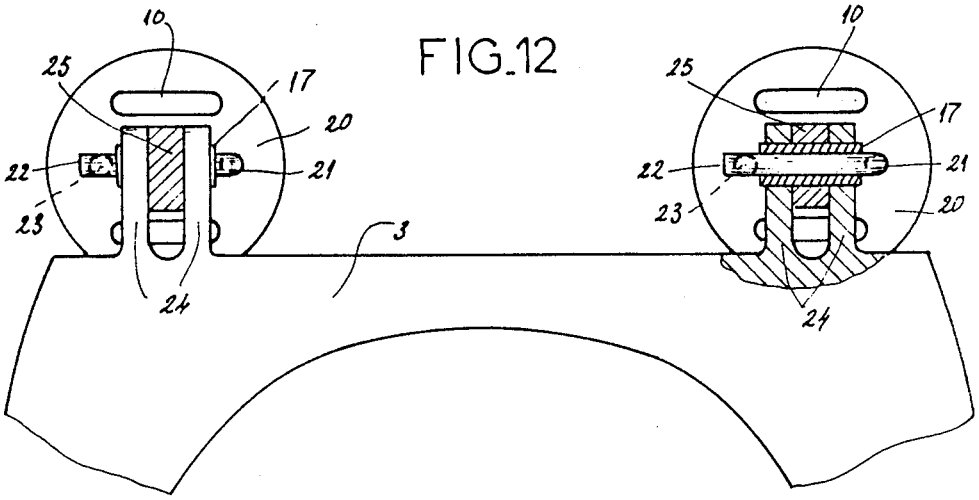
FIG. 12

COVER FOR A TOILET BOWL

FIELD OF THE INVENTION

This invention pertains to a toilet bowl cover, and more specifically a cover comprising a seat and a lid.

BACKGROUND OF THE INVENTION

In traditional embodiments, toilet bowl covers are hinged on the back part of the bowl, attached permanently by bolts. It is consequently very difficult to clean the cover, because parts of it are very difficult to reach, and disassembly and reassembly would be a lengthy and inconvenient process.

In order to avoid these problems and facilitate cleaning, toilet covers have been proposed that comprise a quick fastening device allowing the hinged parts, i.e., the seat on the one hand, and the lid on the other hand, to be disassembled and reassembled relatively easily. Examples of this type of embodiment are provided in Pat. Nos. EP-A-0225427, EP-A-0014325 and U.S. Pat. No. 4,680,816.

In some known embodiments of the preceding type, the seat and lid are hinged on a fixed base around two respective, separate parallel shafts. Thus, in this case, the quick fastening device must be a double one.

In other known embodiments, the seat and lid are mounted to pivot around a mutual hinging shaft. However, the seat is never made unitary with the lid.

Thus, the seat and the lid must always be handled separately during disassembly and reassembly operations. Consequently, these operations are still inconvenient and relatively lengthy to perform, which is not in keeping with the goals of simple and quick disassembly and reassembly.

SUMMARY OF THE INVENTION

This invention avoids these problems, providing a cover having an improved structure in order to allow especially easy and fast disassembly and reassembly.

For this purpose, the object of the invention is a toilet bowl cover comprising a fixed base designed to be attached permanently to the back of the bowl and to accommodate, in a removable manner and through the use of a quick fastening device, a seat and lid that are hinged on the fixed base around a mutual transverse shaft, the cover being characterized in that the seat and lid are joined together along the transverse shaft by a hinge composed of two tubular shafts, and wherein the quick fastening device is designed to attach the seat/lid unit to the fixed base through the locking of the tubular hinge shafts, or to unlock the tubular axes so that the seat/lid unit can be removed without separating the seat from the lid.

In this way, the seat and lid always stay hinged together and form a single unit that is easy to handle during disassembly and reassembly.

In one embodiment, the fixed base is composed of a single elongated part in the form of a plate having supports designed to accommodate the two tubular shafts by means of which the seat and lid hinge together, which provides an additional advantage from the aspect of mechanical resistance.

According to a preferred embodiment, slides for two sliding quick locking parts are provided towards the ends of the fixed base, each of the parts being endowed with a small shaft designed to be inserted into the axial hole in one of the two tubular shafts that serves to hinge the seat and the lid together. Thus, a simple translation movement of the locking parts in either direction, a movement completely guided by the slides of the base, makes it possible to release the seat/lid unit in order to remove the latter, or to lock the unit back on the base.

In one variation of the invention, the fixed base, made in one piece or in two separate pieces, comprises two parts, each holding a transverse shaft which overhangs it and which has a free end designed to accommodate one of the tubular axes which serves to hinge the seat and lid together, so that the tubular shafts can be extracted therefrom by lateral displacement in order to remove the seat/lid unit, still without separating the seat from the lid. Furthermore, in the latter case, the cover can advantageously comprise a locking device composed of pins and flattened surfaces preventing extraction by lateral movement, except when the seat/lid unit is in a specific inclined position.

BRIEF DESCRIPTION OF THE DRAWINGS

The invention will be clearly understood and its advantages disclosed in the description below of two non-restrictive embodiments of the cover according to the present invention, with reference to the attached schematic drawing, wherein:

FIG. 10 is a partial perspective view of a different embodiment of the cover according to the invention;

FIG. 11 is a perspective view of one of the two parts of the base of the cover in FIG. 10;

FIG. 12 is a flat partial and partial cross section top view of the embodiment of a cover;

DETAILED DESCRIPTION OF THE INVENTION

Figure 1:
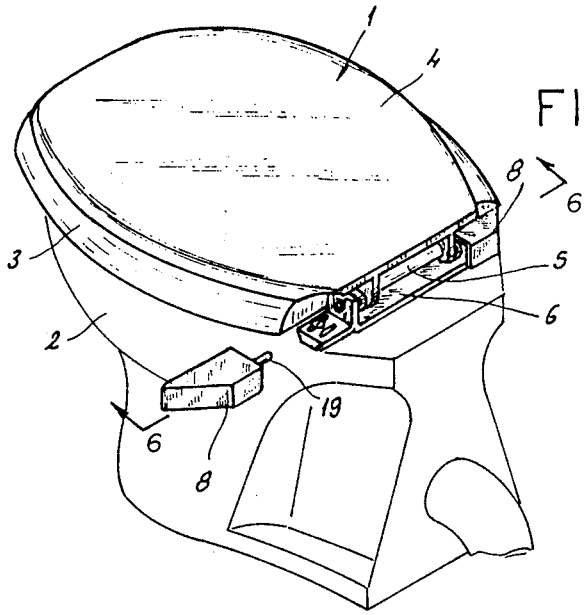
FIG. 1 is a perspective view of a toilet bowl endowed with a cover according to the invention.

First of all, with reference to FIGS. 1 to 9, the cover designated as a unit by 1, which is designed to equip a toilet labeled as 2, conventionally comprises a seat 3 and a lid 4 which are hinged on the back of bowl 2, and which are also joined together around a rear transverse joint or hinge 5, in one or two parts. A fixed base 6 is attached transversely on a permanent basis using bolts 7, to the back of bowl 2 pierced with vertical holes, with base 6 accommodating the unit composed of seat 3, its lid 4 and their hinge 5 by means of a quick locking device comprising two sliding components 8.

Figure 3:
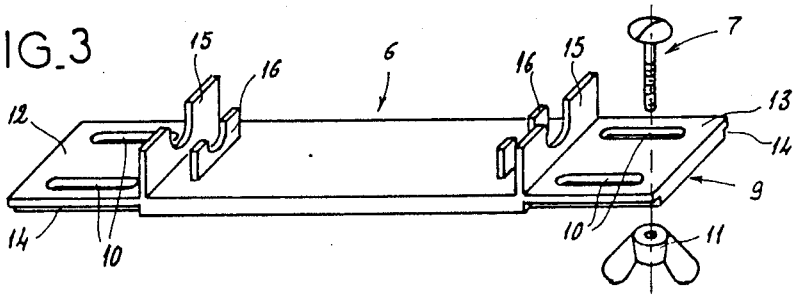
FIG. 3 is a perspective view of the fixed base of the cover.

Base 6 is shown alone in FIG. 3. It is in the general form of an elongated rectangular plate 9 pierced with four longitudinal slots 10 each designed to accommodate a bolt 7 for attachment to the bowl, for example, a bolt with a wing nut 11. In variations, bolt 7 with wing nut 11 can be replaced with a regular screw bolt and nut, with a locking speed step nut from the top, or, more advantageously, with an expanding pin nut, providing the advantage of easy assembly, since it is done only from the top.

Openings 10 are placed in both end parts 12, 13 of plate 9 and the end parts 12, 13 are designed to have longitudinal recesses 14 forming slides to accommodate the aforementioned sliding quick locking components 8.

The upper surface of plate 9 has two pairs of supports 15, 16 positioned closely together. Said pairs of supports 15, 16 are intended each to accommodate one of the two tubular shafts 17, which together form the hinge 5 or joint mentioned above (see FIGS. 5 to 7). It is important to note here that seat 3 and lid 4 stay fastened together on a permanent basis, by means of the two tubular shafts 17.

Figure 4:
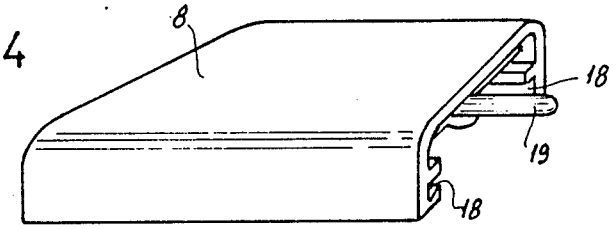
FIG. 4 is a perspective view of one of the two sliding parts for the quick locking of the cover on the base.
Figure 5:
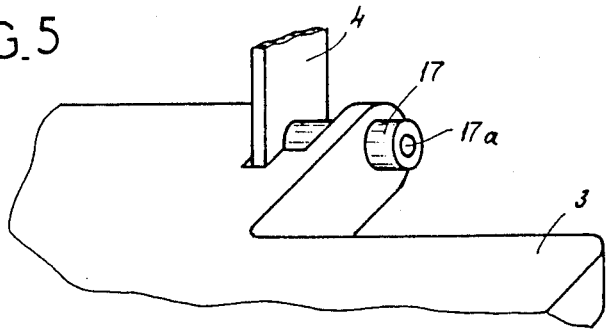
FIG. 5 is a partial detailed perspective view of the cover hinge.
Figure 6:
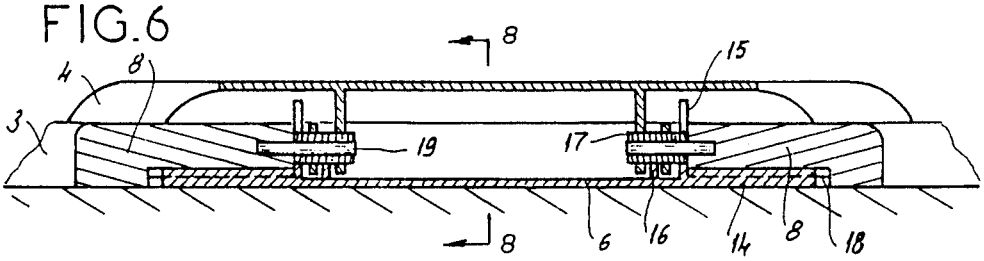
FIG. 6 is a transverse cross section along VI—VI in FIG. 1 of the cover in place on the bowl.

Each of the two locking parts 8 comprises two lateral grooves 18 designed to cooperate with the aforementioned slides 14, and a small central protuberant shaft 19, which is intended to be inserted into axial opening 17*a* in the corresponding tubular shaft 17, in order to ensure the rapid locking of the hinging shaft—see especially FIGS. 4 and 5.

The use of the cover 1 will now be explained with reference to FIGS. 1, 2, 6 and 7. In position for normal use (FIG. 6), the two sliding components 8 are fitted completely into slides 14, so that their two center shafts 19 are totally engaged in the corresponding tubular shafts 17, which fastens the seat/lid unit 3, 4 to fixed base 6. The cover is then in position for regular use, with seat 3 and lid 4 able to pivot separately around their mutual hinge 5.

Figure 2:
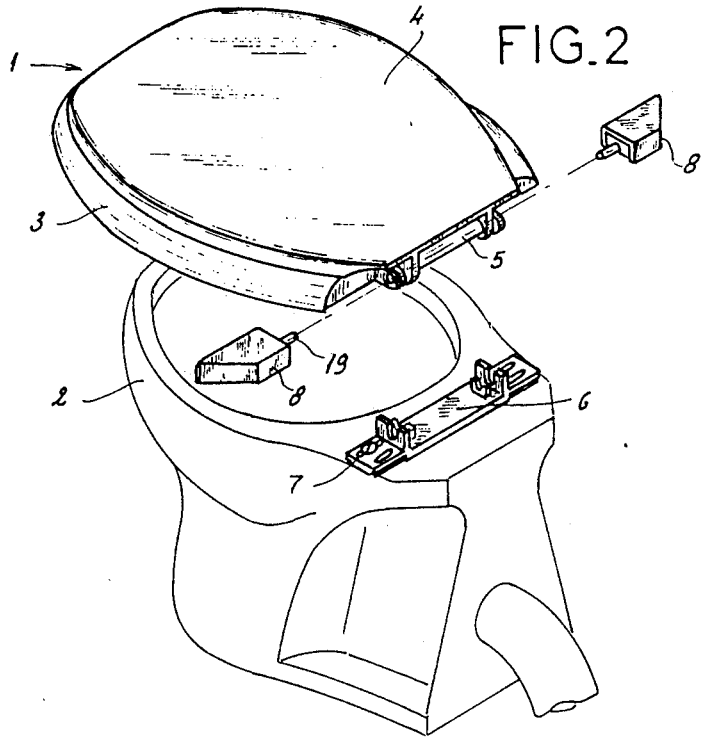
FIG. 2 is a view similar to FIG. 1, with the cover disassembled and removed.
Figure 7:
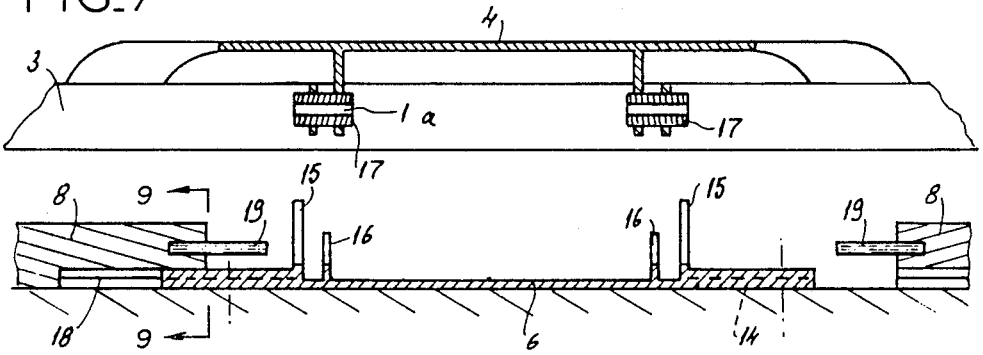
FIG. 7 is a view similar to FIG. 6, with the cover being disassembled and removed.
Figure 8:
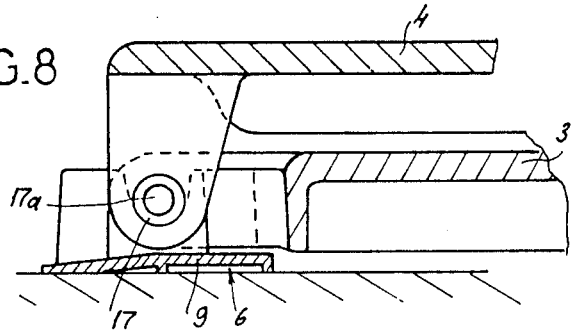
FIG. 8 is a partial longitudinal cross section of the cover along VIII—VIII in FIG. 6.
Figure 9:
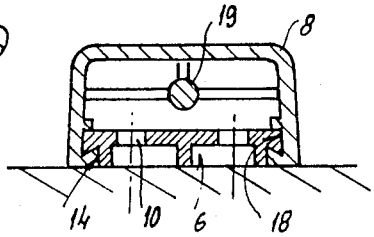
FIG. 9 is a cross section view along IX—IX in FIG. 7.
Figure 13:
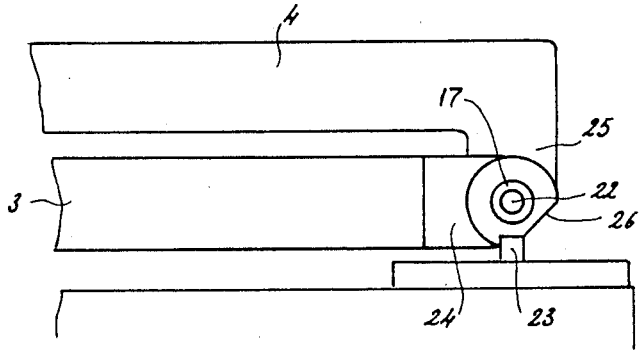
FIG. 13 is a partial side view of the cover in FIGS. 10 to 12, the latter being in closed position on the bowl.
Figure 14:
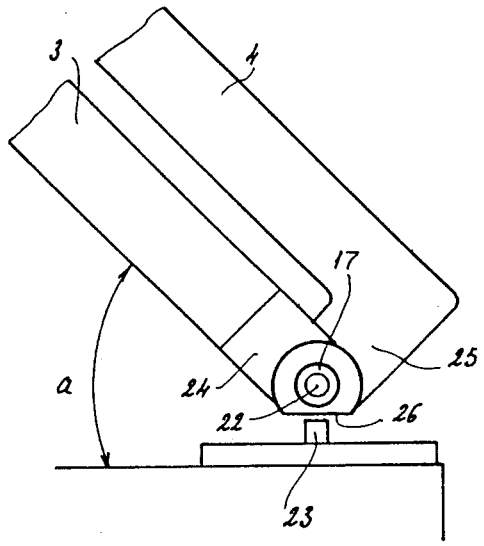
FIG. 14 is a view similar to that in FIG. 13, but with the cover in unhinged position.

For cleaning seat/lid unit 3, 4 and base 6, the two locking components 8 are made to slide laterally, without necessarily removing them, but extracting their shafts 19 fully from associated tubular shafts 17. Seat/lid unit 3, 4 is then released and can be removed by raising, as shown in FIGS. 2 and 7. Of course, the unit can be put back into place by reversing the operations, and a guide (not shown) can be provided to facilitate the exact positioning of tubular shafts 17 on the associated supports 15, 16.

Of course, the invention is not limited to the embodiment according to FIGS. 1 to 9 and many other attachment and quick "unhinging" devices may be used. Solely as an example we will now describe a different embodiment, among many others, with reference to FIGS. 10 to 14.

According to this variation, the preceding base, made in one piece, is replaced by a two-part base 20 (FIG. 11) each part being disk-shaped and pierced with attachment slots 10, each of the disk-shaped parts 20 being attached to one of the fasteners at the back of the bowl, for example, using bolts with wing nuts. Each part of base 20 has a bent transverse shaft 21 that overhangs the plane of the part 20 while being parallel thereto, and has a free end 22 vertically close to a pin 23 projecting from the upper surface of the part 20.

The mutual joint of seat 3 and lid 4 in this case is also composed of two tubular transverse shafts 17, from which seat 3 and lid 4 cannot be separated. Tabs 24 and 25 of seat 3 and lid 4 all have a flattened surface 26 which, when seat/lid unit 3, 4 is inclined at approximately a 45-degree angle with respect to the horizontal plane (FIG. 14), makes it possible to remove the unit 3, 4 by moving it laterally, flattened surfaces 26 in this case passing over pins 23. In the other positions, such as that in FIG. 13, pins 23 prevent tabs 24 and 25 from being extracted by lateral displacement.

"Unhinging" is done in this embodiment without using one or more mobile locking and unlocking components, with the advantage of eliminating any risk of losing the components. However, the back of the cover may be less perfect in terms of aesthetic appearance. It must be noted that the embodiment may also be achieved by making the two parts 20 unitary, using a single transverse base, rectangular in shape, for example, similar to the one in the first embodiment described herein.

It is understood that, in the two sample embodiments described and in all the ensuing variations, we benefit from the advantage that seat 3 and lid 4 remain hinged together on a permanent basis, especially when they are removed and put back into place on base 6 (or 20), which greatly facilitates the handling operations. Moreover, we note that the permanent connection of seat 3 and lid 4 using tubular shafts 17 designed to rest on supports 15, 16 provides a mechanically advantageous embodiment, with the stress exerted on the supports not being transmitted by the small thin shafts 19.

We claim:

1. In a toilet bowl cover having a seat and lid, wherein said seat and lid are attached to a back of the toilet bowl, the improvement comprising:

an fixed elongated rectangular base adapted for permanent attachment on a back of said toil bowl to accommodate a removable quick fastening device for removably locking said seat lid and to the base, a pair of tubular hinge shafts affixed to said seat and lid for pivoting said seat with respect to said lid, said base having an upper surface containing supports thereon adapted pivotally supported tubular hinge shafts and recess means extending along opposite ends of said base;

said tubular shafts having axial holes therein that permanently hold said seat and lid together in hinged relationship; and said removable quick fastening device comprising two sliding parts having channel means adapted to slidingly engage said recess means on said base, said device having protuberant shafts that fit in locking relationship with said axial holes in said tubular shafts when slidingly mounted on said base.

* * * * *